United States Patent [19]

Worsham

[11] 4,104,867

[45] Aug. 8, 1978

[54] WATER-TIGHT WATCH CASE

[75] Inventor: Daniel A. Worsham, San Jose, Calif.

[73] Assignee: Pacific Western Systems, Mountain View, Calif.

[21] Appl. No.: 662,145

[22] Filed: Feb. 27, 1976

[51] Int. Cl.[2] ..... G04B 37/00; G04B 37/08

[52] U.S. Cl. ..... 58/90 R; 58/55; 206/18; 206/305; 220/352

[58] Field of Search ..... 58/53–55, 58/88, 90 R, 90 B; 206/18, 301, 305; 220/228, 240, 352

[56] References Cited

U.S. PATENT DOCUMENTS

| | | | |
|---|---|---|---|
| 2,587,087 | 2/1952 | Arnoux | 58/90 R |
| 2,951,333 | 9/1960 | Morf | 58/90 R |
| 3,418,802 | 12/1968 | Little et al. | 58/55 X |
| 3,490,177 | 1/1970 | Perrion | 220/352 |

*Primary Examiner*—Edith S. Jackmon

*Attorney, Agent, or Firm*—Harry E. Aine; Harvey G. Lowhurst

[57] ABSTRACT

The water-tight watch case is disclosed wherein the case provides a water-tight enclosure for an electronic watch module and wherein the case includes a removable cover portion for providing physical access to the interior of the case for replacement of batteries and the like. The removable cover portion includes a truncated conically tapered sealing ring surface having an angle of taper less than 8° and preferably in the range of 7° to 3° for providing an interference-contact axial press fit with a mating truncated conically tapered surface of the case. A water-tight seal is formed between the cover and the case essentially solely due to the axially pressed interference-contact fit between the pair of mated tapered sealing ring surfaces.

8 Claims, 4 Drawing Figures

WATER-TIGHT WATCH CASE

BACKGROUND OF THE INVENTION

The present invention relates in general to water-tight watch cases and more particularly to an improved back cover seal for such watch cases.

DESCRIPTION OF THE PRIOR ART

Heretofore, fluid tight wristwatch cases have included a removable back cover for gaining access to the interior of the watch case. Such back covers have typically been secured to the main body of the watch case structure, in a fluid or water tight manner, by either a threaded coupling including an O-ring seal or by means of a snap-on coupling which also included a resilient compressible O-ring or elastomeric gasket to provide a water-tight seal therebetween.

The problem with the back cover seal which employs a compressible resilient gasket or O-ring, is that the O-ring is relatively fragile and can withstand only a relatively few number of opening and closing cycles before the O-ring is damaged so as to allow leakage of liquid therethrough. In addition, machining of the retaining grooves for the O-ring and machining of the threaded coupling grooves for a threaded case is relatively expensive.

Therefore, it is desirable to provide an improved back cover mechanism for a wristwatch case which is inexpensive of manufacture, permits a good water-tight seal to be formed, allows opening and closing of the watch cover without incurring damage to the water-tight integrity of the seal, and which provides a closure mechanism utilizing a minimum of the thickness of the watch casing so that the closure mechanism may be employed in thin wristwatch configurations.

SUMMARY OF THE PRESENT INVENTION

The principal object of the present invention is the provision of an improved water-tight wristwatch case having an improved removable cover portion for providing access to the interior of the watch case.

In one feature of the present invention, a removable cover portion of the watch case is sealed in a water-tight manner to the main body of the watch case via the intermediary of a mated annular truncated conically tapered sealing ring surface portion which provides a water-tight seal due to an interference-contact fit between the mated sealing portions.

In another feature of the present invention, a removable cover portion of the watch case is sealed to the remainder of the watch case body via the intermediary of a truncated conically tapered sealing ring portion having an angle of taper falling within the range of 7° to 3°.

In another feature of the present invention, a removable cover portion of the watch case is sealed to the remainder of the watch case body by means of mated truncated conically tapered sealing ring portions providing an interference-contact fit and seal therebetween such seal being essentially free of resilient compressible packing structure.

Other features and advantages of the present invention will become apparent upon a perusal of the following specification taken in connection with the accompanying drawings wherein:

DESCRIPTION OF THE PREFERRED EMBODIMENTS

Figure 1:
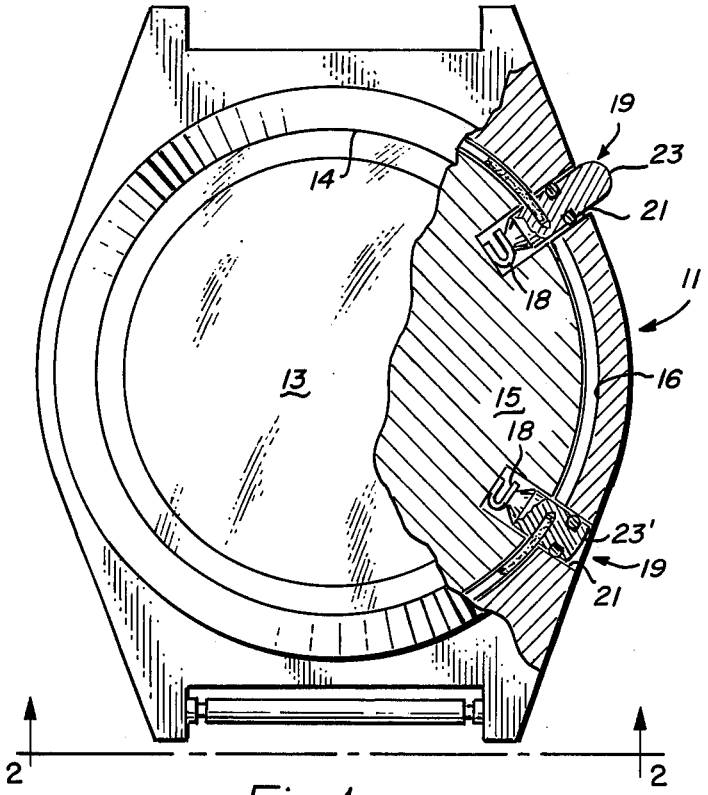
FIG. 1 is a bottom plan view of a watch case incorporating features of the present invention.
Figure 2:
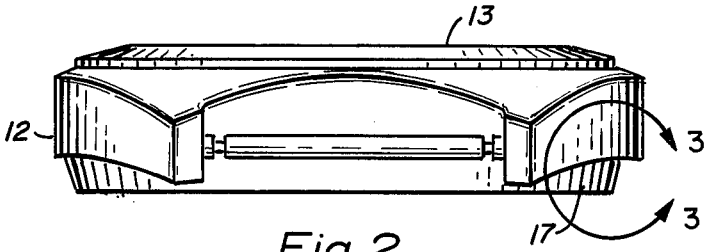
FIG. 2 is an elevational view of the structure FIG. 1 taken along line 2—2 in the direction of the arrows.

Referring now to the drawings there is shown an electronic wristwatch 11 incorporating features of the present invention. More particularly, the wristwatch includes a watch casing 12, as of stainless steel having a window portion 13 as of glass, sealed, as by a compression seal or glue at 14, for closing the upper face of the casing 12. The window permits viewing of the watch display, not shown, carried on the upper face of a circular disc-shaped electronic watch module 15 contained within a circular cavity 16 of the watch casing 12. The back face of the watch casing 12 is closed off by means of a cover cap 17, as of stainless steel.

The watch module 15 includes electronic circuitry forming the timepiece of the watch assembly 11. Certain functions of the electronic watch, such as setting of the time, display of the time, display of the month and day, and the like are generated by actuating one or more switch assemblies 18 carried with recesses generally at the outer periphery of the watch module 15 at circumferentially spaced positions. The switch assemblies 18 are actuated by means of actuator pin assemblies 19 passing through radially directed bores 21 in the side wall of the watch casing 12.

Figure 3:
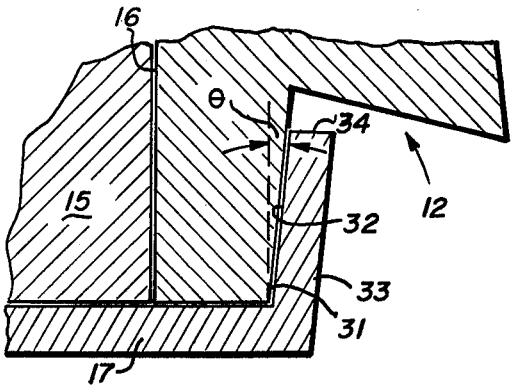
FIG. 3 is an enlarged sectional view of a portion of the structure of FIG. 1 delineated by line 3—3.

Referring now to FIG. 3, the back cover cap 17 and its seal are shown in greater detail. More particularly, the back face portion of the watch case 12 includes an outside truncated conically tapered surface 31 for mating with a similarly tapered inside truncated conical surface 32 on the outside lip portion 33 of the cover cap 17. The angle of taper $\theta$, i.e., the angle $\theta$ that the conically-shaped surfaces 31 and 32 make with the axis of revolution of the respective surfaces is chosen at an angle less than 8° so that a water-tight interference-contact seal is obtained between the two mated press-fitted conical surfaces 31 and 32. The angle of taper $\theta$ is preferably as large an angle as possible, compatible with obtaining a water-tight interference seal between the mating surfaces 31 and 32, due to the loss of precision in the axial spacing of the parts 17 and 12 when the angle of taper is in the low end of the range, i.e., less than 3°. A particularly suitable taper angle $\theta$ is $5° \pm 1°$.

The cover cap 17 is merely axially press-fitted over the open end of the watch case 12 to provide the water-tight interference fit between the surfaces 31 and 32. The cover is removed by merely prying the cover 17 off of the case 12 by means of an implement placed between the inner edge portion 34 of the lip 33 and the watch case 12. In a typical example, the cover cap 17 has an outside diameter of 1.210 inches and an outside depth of the lip portion 33 of 0.090 inch.

Figure 4:
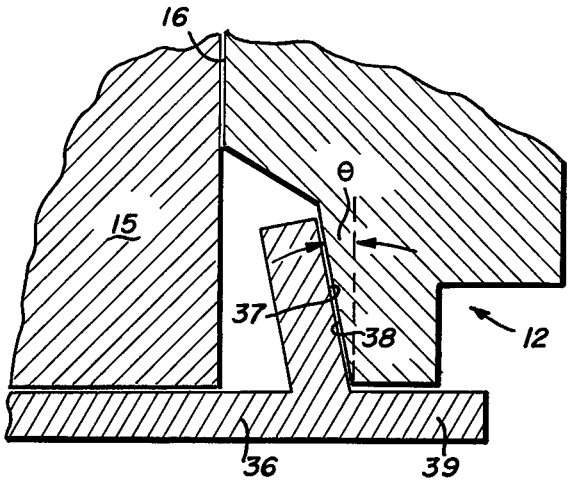
FIG. 4 is a view similar to that of FIG. 3 having an alternative embodiment of the present invention.

Referring now to FIG. 4, there is shown an alternative embodiment of the cover cap 17 of FIG. 3. More particularly, the alternative cover cap 36 has an outside truncated conically tapered sealing surface 37 mating with a similarly tapered inside truncated conical surface 38 on the watch case 12. The cover cap 36 includes an outer lip portion 39 so that a prying tool may fit between the lip portion 39 and the case 12 for prying the cover 36 from the watch case. As in the previous example of FIG. 3, the angle of taper $\theta$ is less than 8° and in a preferred embodiment is approximately 5° ± 1°.

The advantage to the cover caps 17 and 36 of the present invention is that the cover cap makes a water-tight seal to the case solely due to an interference-contact fit between the truncated conically tapered sealing surfaces. The cap may be removed as many times as desired to replace batteries or the like within the case 12 without destroying the integrity of the seal formed between the mating surfaces. The seal is also made without the aid of a resilient compressible packing ring material or the like which can deteriorate with time and with usage to cause malfunctions of the water-tight seal.

Although the preferred embodiment of the present invention employs a pair of mated truncated conical sealing surfaces, it is not a requirement that both the inside and outside sealing surfaces be conical. More particularly, it is only necessary that the inside facing sealing surface be of truncated conical shape. The sealing surface facing outwardly for mating with the inside surface may have circular contours other than conical, such as rounded, pointed, etc. However, when both sealing surfaces are conical, the depth of the mating surfaces helps to axially align the cover 17 to the case 12, i.e., prevents canting of the cover relative to the case 12. The sealing surface finish is preferably better than 16 microinches RMS.

What is claimed is:

1. In a fluid tight watch case:

case means for enclosing a timepiece in a water-tight manner;

said case means having a removable cover portion for providing physical access to the interior of said case means when said cover portion is removed; and said case means and said cover portion thereof, each having an annular generally incompressible sealing ring surface portion formed and arranged so as to permit substantial relative axial translation therebetween for axially press fitting together in water-tight sealing engagement to form an annular water-tight seal therebetween, one of said annular sealing surfaces being disposed facing radially inwardly of said annular seal to be formed and disposed for mating with the other annular sealing surface which faces radially outwardly and wherein said inwardly facing annular sealing surface is of a truncated conically tapered configuration, said water-tight seal being made essentially solely due to an axially pressed interference-contact fit between said pair of mated annular sealing ring surface portions.

2. The apparatus of claim 1 wherein said truncated conically tapered sealing surface portion has an angle of taper less than 8° relative to the axis of revolution of the annular sealing surface portion.

3. The apparatus of claim 2 wherein said angle of taper falls within the range of 7° to 3°.

4. The apparatus of claim 1 wherein the resultant water-tight seal between said cover portion and the remaining portion of said case means is essentially free of resilient compressible packing structure.

5. The apparatus of claim 1 wherein both said inwardly and outwardly facing annular sealing surface portions are of a truncated conically tapered configuration.

6. The apparatus of claim 5 wherein both of said conically tapered annular sealing surface portions have an angle of taper falling in the range of 4° to 6°.

7. The apparatus of claim 1 wherein said radially inwardly facing truncated conical sealing surface has a surface finish smoother than sixteen microinches RMS.

8. The apparatus of claim 5 wherein said radially inwardly facing truncated conical sealing surface has a surface finish smoother than sixteen microinches RMS.

* * * * *